US006634346B2

(12) United States Patent
Bircann et al.

(10) Patent No.: US 6,634,346 B2
(45) Date of Patent: Oct. 21, 2003

(54) BEARING MODULE FOR EXHAUST GAS RECIRCULATION VALVE

(75) Inventors: Raul A. Bircann, Penfield, NY (US); Dwight O. Palmer, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/955,528

(22) Filed: Sep. 18, 2001

(65) Prior Publication Data

US 2003/0051712 A1 Mar. 20, 2003

(51) Int. Cl.[7] ..... F02M 25/07
(52) U.S. Cl. ..... 123/568.21; 251/129.16
(58) Field of Search ..... 251/129.11, 129.03, 251/129.07, 129.08, 129.15, 129.16; 123/568.11, 568.21, 568.27, 90.37, 90.11

(56) References Cited

U.S. PATENT DOCUMENTS

| | | | | |
|---|---|---|---|---|
| 4,497,335 A | | 2/1985 | Masuda | |
| 4,998,707 A | * | 3/1991 | Meyer et al. | 251/129.15 |
| 6,062,536 A | * | 5/2000 | Bircann | 251/129.15 |

FOREIGN PATENT DOCUMENTS

| | | | |
|---|---|---|---|
| DE | 19950871 | | 4/2001 |
| EP | 1126186 | | 8/2001 |
| WO | WO 95/25883 | * | 9/1995 |

* cited by examiner

*Primary Examiner*—Henry C. Yuen
*Assistant Examiner*—Arnold Castro
(74) *Attorney, Agent, or Firm*—Patrick M. Griffin

(57) ABSTRACT

A subassembly module including a pintle bearing, bearing retaining spring, and bearing splash shield for an exhaust gas recirculation (EGR) valve for an internal combustion engine. The bearing is provided with a circumferential flange for sealing with an outer surface of the valve body, and with an annular step in the flange for receiving the rolled or crimped skirt of the bearing splash shield. The bearing retaining spring surrounding the valve pintle is compressed and captured within the splash shield as the skirt is formed onto the annular step to form the module. The axial length of the module is slightly greater than the assembled distance between the valve body and the actuator of the EGR valve, such that the module is compressed by installation of the actuator onto the valve body, allowing the compressed spring to urge the bearing face sealingly against the valve body. Advantageously, the subassembly module may be pre-assembled offline by known methods to reduce complexity during assembly of the valve.

8 Claims, 4 Drawing Sheets

BEARING MODULE FOR EXHAUST GAS RECIRCULATION VALVE

TECHNICAL FIELD

The present invention relates to pintle valves for permitting the controlled admission of exhaust gases into the fuel intake manifold of an internal combustion engine; more particularly, to the pintle bearing, bearing retaining spring, and bearing splash shield of such a valve; and most particularly to a modular subassembly which may be pre-assembled and which combines these three components for ease of manufacture of the valve, reduction in assembly errors, and reduced cost of manufacture.

BACKGROUND OF THE INVENTION

It is well known in the automotive art to provide a variable valve connecting the exhaust manifold with the intake manifold of an internal combustion engine to permit selective and controlled recirculation of a portion of an engine's exhaust gas into the fuel intake stream. Such recirculation is beneficial for reducing the burn temperature of the fuel mix in the engine to reduce formation of nitrogen and sulfur oxides which are significant components of smog. Such a valve is known in the art as an exhaust gas recirculation (EGR) valve. Typically, an EGR valve has a valve body enclosing a chamber disposed between a first port in the exhaust manifold and a second port in the intake manifold; a valve seat dividing the chamber between the two ports; a pintle valve having a valve head fitted to the valve seat and a valve stem or pintle extending from the valve head through a bearing mounted in a third port in a sidewall of the valve body; and a solenoid actuator mounted on the exterior of the valve body and operationally connected to the outer end of the valve stem. Because exhaust gas may leak along the valve stem, the actuator typically is mounted on standoffs to vent such leaking exhaust gas and thereby prevent it from entering and corroding the solenoid. The bearing has a circumferential flange for sealing against an outer surface of the valve body and may be urged to seal by a spring which is compressed and captured between the valve body and the actuator, such as a compressed coil spring surrounding the valve stem. An EGR valve having such a standoff configuration may be exposed to various environmental hazards, such as mud and salt from roadways, which can corrode the exposed valve stem and spring or accumulate on the bearing, eventually fouling the stem and disabling the valve. Therefore, a cup-shaped bearing splash shield extending axially over the spring and bearing typically is provided to protect the bearing, stem, and spring from external contamination.

During assembly of such a prior art valve, after the valve head is inserted into the chamber via the third port, the bearing is threaded onto the pintle and seated against the valve body, then the spring is installed onto the pintle, then the splash shield is installed over the spring, and then the actuator pole piece is attached to the outer end of the pintle and the actuator is bolted to the valve body through a plurality of hollow standoffs, thus capturing the spring against the underside of the shield and compressing the spring to the proper degree. This procedure requires manual alignment of the various parts, which are loose and which must be mutually aligned for proper assembly; thus, the valve is easily subject to misassembly.

What is needed is a modular subassembly of the bearing, spring, and shield which is readily pre-assembled offline, which is self-aligned by the pintle; in which the spring is preloaded to a predetermined and repeatable compression; and which is readily installed as a single component on the valve pintle by an assembly operator.

SUMMARY OF THE INVENTION

The present invention is directed to a subassembly module comprising a pintle bearing, bearing retaining spring, and bearing splash shield for an exhaust gas recirculation valve for an internal combustion engine. The bearing is provided with a circumferential flange for sealing on an axial face thereof with an outer surface of the valve body, and with an annular step for receiving the rolled or crimped skirt of the bearing splash shield. The bearing retaining spring surrounding the valve pintle is compressed and captured within the splash shield as the skirt is formed onto the annular step to form the module. The axial length of the module between the outer end of the shield and the axial face of the bearing flange is slightly greater than the assembled distance between the valve body and the actuator of the EGR valve, such that the spring is further compressed by installation of the actuator onto the valve body to urge the first circumferential bearing face sealingly against the valve body. Advantageously, the subassembly may be pre-assembled offline by known methods to reduce complexity during assembly of the valve.

BRIEF DESCRIPTION OF THE DRAWINGS

The foregoing and other objects, features, and advantages of the invention, as well as presently preferred embodiments thereof, will become more apparent from a reading of the following description in connection with the accompanying drawings, in which.

DESCRIPTION OF THE PREFERRED EMBODIMENT

Figure 1:
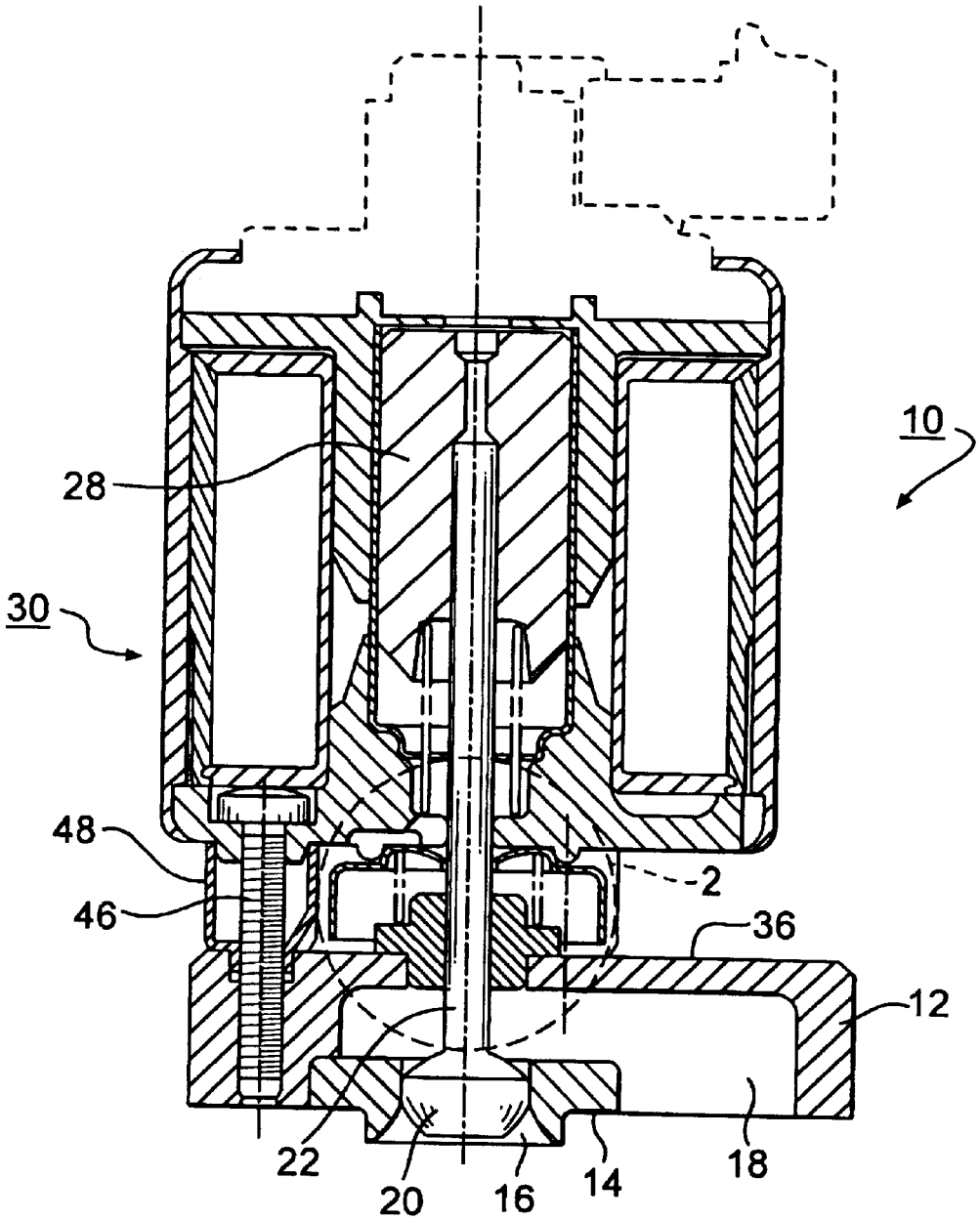
FIG. 1 (PRIOR ART)
FIG. 1 is an elevational cross-sectional view of a prior art EGR valve.
Figure 2:
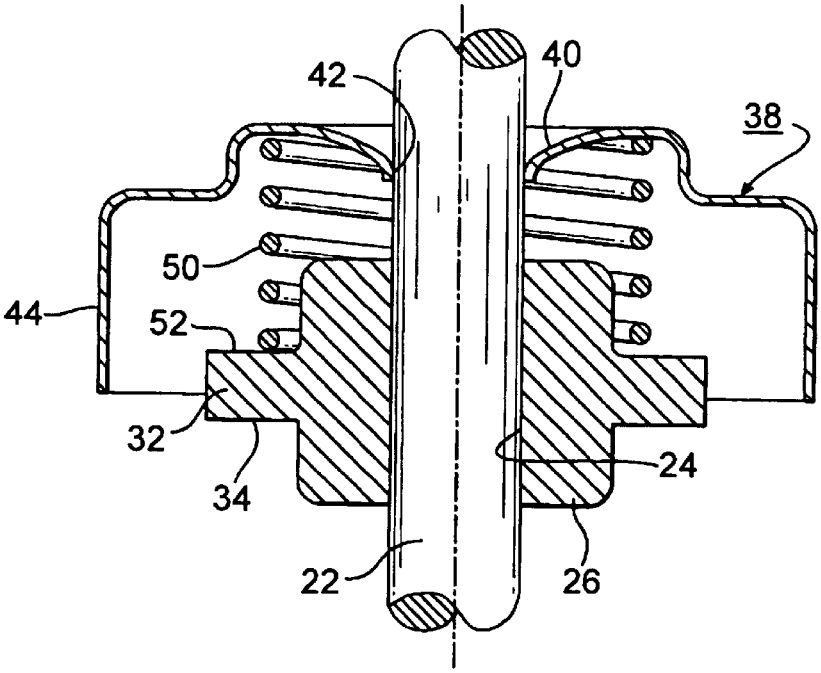
FIG. 2 (PRIOR ART)
FIG. 2 is an enlarged and detailed view of area 2 in FIG. 1, showing the bearing, bearing spring, and bearing splash shield as separate components.
Figure 3:
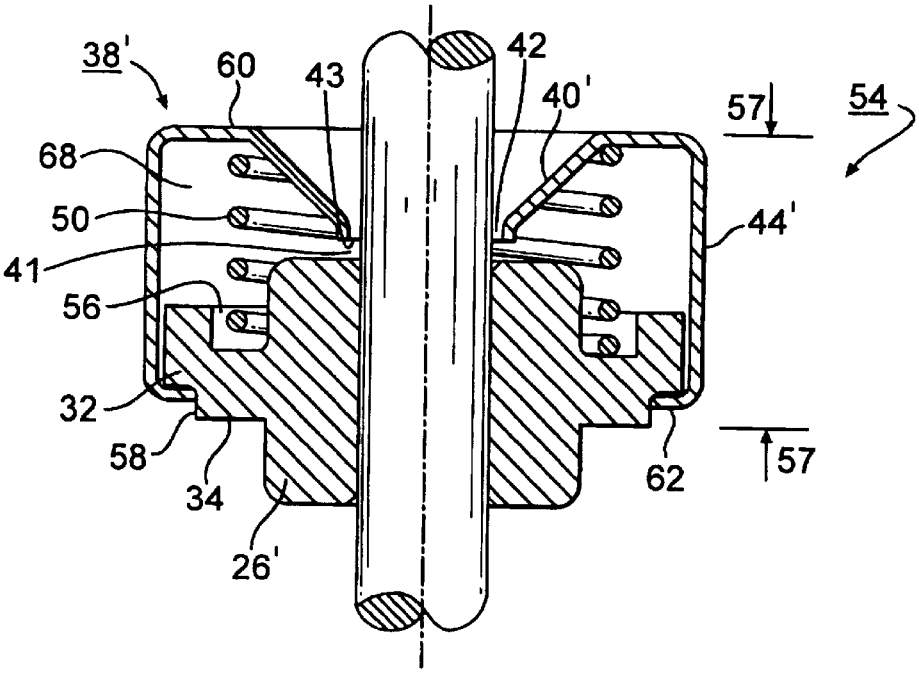
FIG. 3 is an elevational cross-sectional view of a first embodiment of a bearing subassembly module in accordance with the invention.

The benefits afforded by the present invention will become more readily apparent by first considering a prior art valve. Referring to FIGS. 1 and 2, a prior art EGR valve 10 includes a valve body 12 having a valve seat 14 separating a first chamber 16 from a second chamber 18, which chambers may communicate with the exhaust and intake systems, respectively, of an internal combustion engine (not shown) or the reverse. Valve head 20 is disposed adjacent to seat 14 for selectively mating therewith to open or to close communication between chambers 16 and 18. Valve stem, or pintle, 22 extends from head 20 through an axial bore 24 in bearing 26 and is captured within armature 28 of solenoid actuator 30. Bearing 26 is disposed in a port 27 in a wall of valve body 12 and guides stem 22 in reciprocating motion to open and close the valve when actuator 30 is energized and de-energized, respectively. Bearing 26 is provided with a circumferential flange 32 having a first axial face 34 for sealing against axial outer surface 36 of valve body 12 to prevent leakage of gases therebetween. A cup-shaped bearing splash shield 38 has an inward-extending flange 40 with a central aperture 42 for passage of stem 22, preferably without contact therebetween, and a cylindrical skirt 44 extending axially to shield a substantial portion of bearing 26 from external contaminants. Shield 38 is open in a downwards direction to permit venting of any gases which may leak along bore 24 during operation of the valve. Actuator 30 is connected to valve body 12 via a plurality of bolts 46 extending through a plurality of standoffs 48. A coil spring 50 surrounding stem 22 is disposed within shield 38, being compressed between actuator 30 and a second surface 52 on flange 32 for urging flange 32 to seal against surface 36 under all operating conditions. Spring 50 also serves to urge shield 38 against actuator 30 to prevent dust intrusion into the actuator.

As noted above, the stem, bearing, spring, shield, standoffs, bolts, and actuator are all loose components which must be manually and simultaneously accommodated during assembly of the valve, which can be a complex and difficult task for an assembly operator. It is a primary objective of the invention to simplify the final assembly of the valve by reducing the number of individual components to be assembled, by combining the spring and a modified bearing and modified splash shield into a pre-assemblable subassembly module. An additional benefit of the invention is that the subassembly module is axially self-adjusting to accommodate the stack-up of axial manufacturing variation in lengths of the standoff, thus relaxing the manufacturing tolerance for each component.

Figure 4:
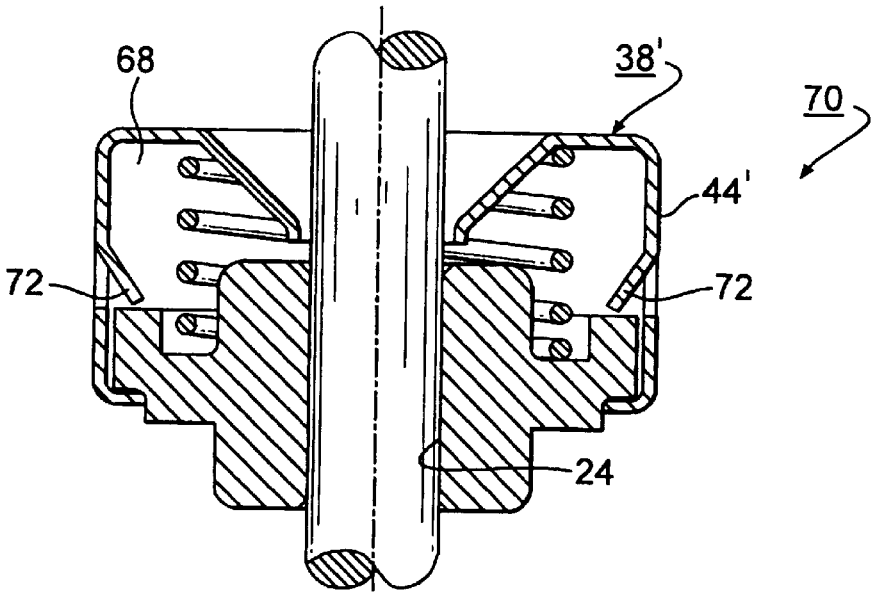
FIG. 4 is an elevational cross-sectional view like that shown in FIG. 3, showing venting provisions for a second embodiment of a bearing subassembly module.
Figure 5:
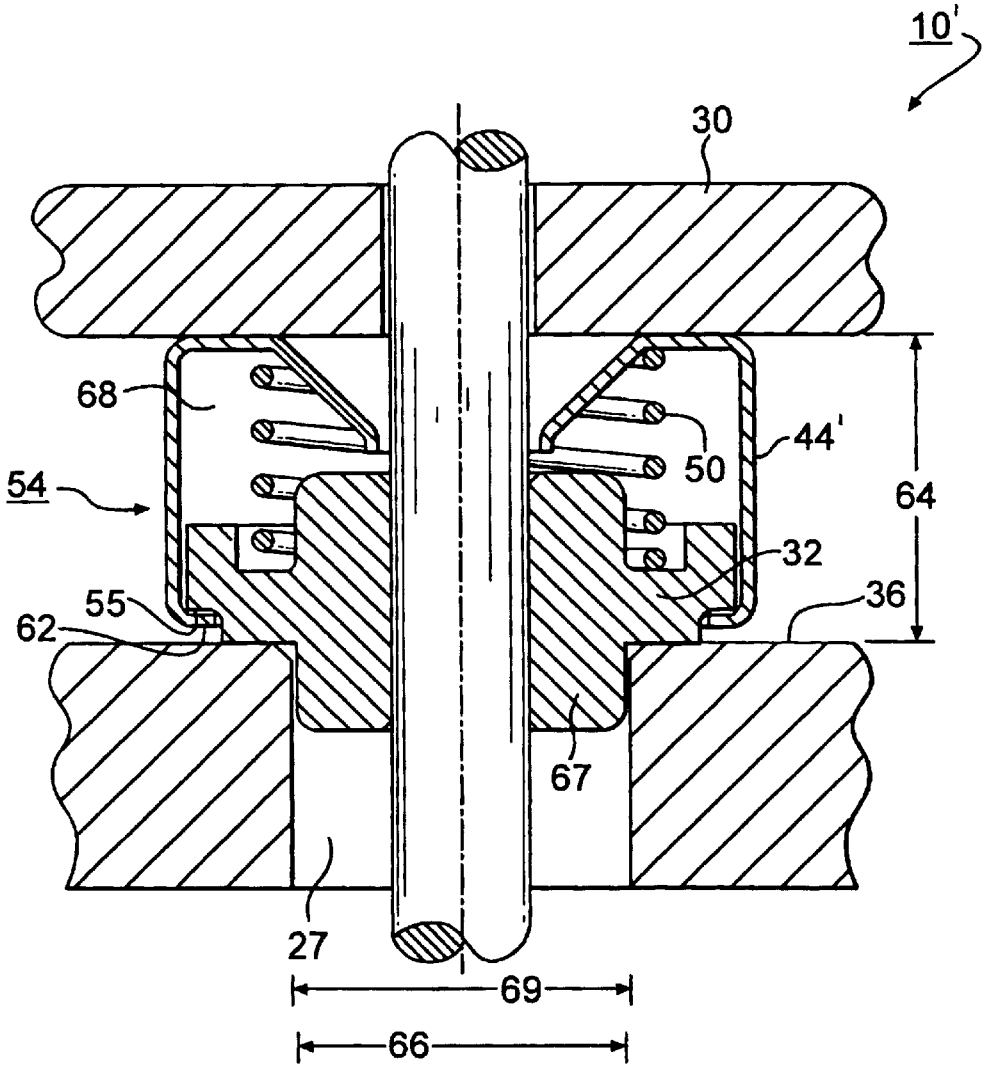
FIG. 5 is an elevational cross-sectional view showing the subassembly module shown in FIG. 3 installed in a partial and idealized EGR valve.

Referring to FIGS. 3–6, a subassembly module 54 is intended for direct replacement of the assembly of loose parts 26,38,50 shown in FIG. 2 to provide an improved EGR valve 10', shown partially in FIG. 5. Bearing 26' is modified over bearing 26 to include an annular step 58 in flange 32, and also preferably an annular well 56 in flange 32 for more positive seating and centering of spring 50. Skirt 44' on splash shield 38' (which is formed as by stamping from sheet metal) is axially longer than skirt 44. Flange 40' is formed such that an axial clearance 41 exists between the inner edge 43 of flange 40' and bearing 26'.

To pre-assemble module 54, bearing 26', spring 50, and shield 38' are positioned, for example, in a conventional jig, wherein spring 50 is compressed and the axial length 57 of module 54 between face 34 and upper surface 60 of shield 38' is fixed. The free edge 62 of skirt 44' is then rolled or staked radially inwards into step 58 and against axial face 55 to lock the module components together. After removal from the jig, the module is ready for assembly into valve 10'. Preferably, length 57 is slightly greater than the assembled spacing 64 between actuator 30 and the valve surface 36, as shown in FIG. 5, so that module 54 is compressed, edge 62 is lifted off of face 55, and the compressed force of spring 50 is directed through flange 32 against valve surface 36 to form the seal. It should be noted that the configuration of skirt 44' in the subassembly module provides complete enclosure of the interior chamber 68 of the splash shield, thus providing a significant improvement in bearing splash protection over the prior art shield.

Preferably, the diameter 66 of the portion 67 of bearing 26' extending into port 27 is slightly less than the diameter 69 of port 27 to permit the bearing to float radially as may be required for valve head 20 to seat conformably in seat 14.

Referring to FIG. 4, during use of the valve some exhaust gases, especially moisture-laden gases, may be found to leak along bore 24 into chamber 68. In alternate module embodiment 70, skirt 44' of shield 38' is provided with a plurality of vents 72, which may be formed for example as by stamping or punching in skirt 44'. Vents formed as bent flaps, as shown in FIG. 4, can provide adequate venting of gases while not compromising the shielding function of shield 38'.

Figure 6:
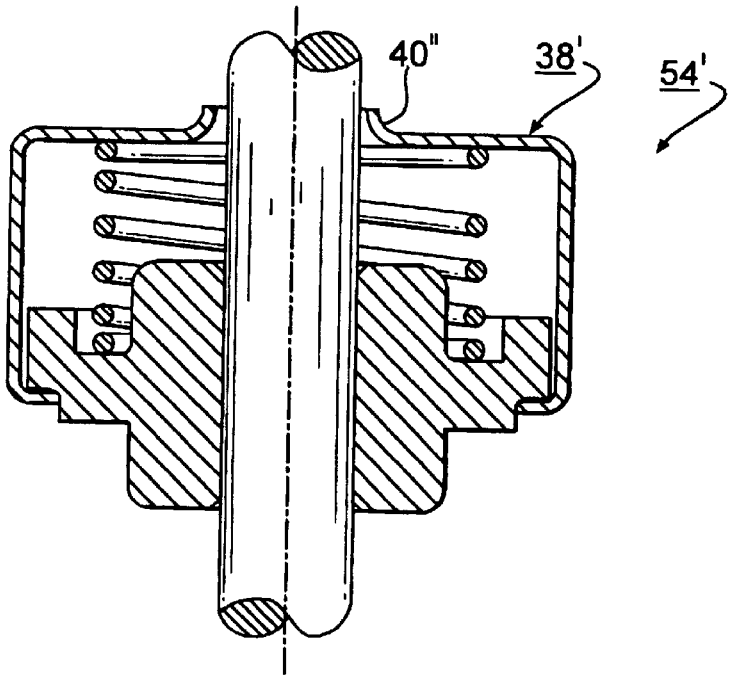
FIG. 6 is an elevational cross-sectional view of a third embodiment of a bearing subassembly module in accordance with the invention.

Referring to FIG. 6, in mating with some known actuators, it may be desirable for flange 40' to be flared axially toward the actuator, as shown as flange 40" on embodiment 54'. Alternative shapes for flange 40' are fully within the scope of the invention.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. A subassembly module for use in a pintle valve having a valve body and a valve pintle extending from the valve body, comprising:

a) a bearing mountable on said body and having an axial bore for receiving and guiding said pintle;

b) a bearing splash shield having an axial opening for receiving said pintle and having a skirt surrounding said bearing, said skirt having a free edge formed to slidably retain said shield on said bearing; and c) a spring disposed between said bearing and said splash shield for urging said bearing against said valve body during operation of said valve.

2. A subassembly module in accordance with claim 1 wherein said bearing has a circumferential flange having a first axial face for sealably mating with said valve body, means for receiving said formed free edge of said skirt, and means for receiving said spring.

3. A subassembly module in accordance with claim 1 wherein said splash shield has an inwardly- and axially-extending radial flange surrounding said axial opening.

4. A subassembly module in accordance with claim 3 wherein said radial flange extends axially towards said valve body when said valve is fully assembled.

5. A subassembly module in accordance with claim 3 wherein said radial flange extends axially away from said valve body when said valve is fully assembled.

6. A subassembly module in accordance with claim 1 wherein said free edge of said skirt is turned radially inwards to engage said bearing.

7. An exhaust gas recirculation valve for use in an internal combustion engine, said valve having a valve body and a valve pintle extending from said valve body, comprising a bearing module having a bearing mountable on said valve body for receiving and guiding said pintle, a bearing splash shield having an axial opening for receiving said pintle and having a skirt surrounding a portion of said bearing and having a free edge formed to be slidably retained on said bearing, and a spring disposed between said bearing and said splash shield for urging said bearing against said valve body during operation of said valve.

8. An internal combustion engine, comprising:

a) an intake manifold having a first port therein;

b) an exhaust manifold having a second port therein; and c) an exhaust gas recirculation valve connected between said first and second ports, said valve having a valve body and a valve pintle extending from said valve body, comprising a bearing module having a bearing mountable on said valve body for receiving and guiding said pintle, a bearing splash shield having an axial opening for receiving said pintle and having a skirt surrounding a portion of said bearing and having a free edge formed to be slidably retained on said bearing, and a spring disposed between said bearing and said splash shield for urging said bearing against said valve body during operation of said valve.

* * * * *